US005374794A

United States Patent [19]

Holmes

[11] Patent Number: 5,374,794

[45] Date of Patent: Dec. 20, 1994

[54] ELEVATOR CONTROL VALVE ASSEMBLY

[75] Inventor: William K. Holmes, San Diego, Calif.

[73] Assignee: United States Elevator Corp., Spring Valley, Calif.

[21] Appl. No.: 164,419

[22] Filed: Dec. 9, 1993

[51] Int. Cl.[5] ..... B66B 1/00

[52] U.S. Cl. ..... 187/275; 187/276; 187/393; 91/454

[58] Field of Search ..... 187/29.2, 17, 111, 110; 91/446, 454, 459, 461

[56] References Cited

U.S. PATENT DOCUMENTS

| | | | |
|---|---|---|---|
| 2,355,164 | 8/1944 | Jaseph | 187/29 |
| 3,187,844 | 6/1965 | MacNair | 187/29 |
| 3,706,357 | 12/1972 | Simpson | 187/29 |
| 3,707,166 | 12/1972 | Lawrence et al. | 137/596.16 |
| 3,977,497 | 8/1976 | McMurray | 187/29 |
| 4,000,754 | 1/1977 | Risk | 137/487 |
| 4,011,888 | 3/1977 | Whelchel et al. | 137/612.1 |
| 4,148,248 | 4/1979 | Risk | 91/446 |
| 4,153,074 | 5/1979 | Risk | 137/596.12 |
| 4,457,211 | 7/1984 | Risk | 91/446 |
| 4,676,140 | 6/1987 | Haussler | 91/454 |
| 4,694,935 | 9/1987 | Lawrence | 187/111 |
| 5,014,823 | 5/1991 | Huikko | 91/454 |
| 5,046,586 | 9/1991 | Pelto-Huikko | 187/17 |
| 5,082,091 | 1/1992 | Fargo | 187/17 |
| 5,289,901 | 3/1994 | Fargo | 91/454 |

FOREIGN PATENT DOCUMENTS 1378345 12/1974 United Kingdom .

*Primary Examiner*—Kenneth W. Noland
*Attorney, Agent, or Firm*—Brown, Martin, Haller & McClain

[57] ABSTRACT

A control valve assembly for an hydraulically operated elevator includes separate control valve units for controlling upwards and downwards movements of the elevator. The up valve unit is connected to a pump output and controls connection of the pump output to the elevator cylinder via a check valve. The up valve unit includes an orifice for connecting the pump output to a reservoir, and a valve member for varying the size of the orifice to control the amount of fluid passed to the reservoir, and thus the amount of fluid supplied to the elevator cylinder. The down valve unit has an inlet for connection to the elevator cylinder, a variable orifice connected to a reservoir, and a valve member for controllably varying the size of the orifice to control the rate of descent of the elevator.

29 Claims, 5 Drawing Sheets

ELEVATOR CONTROL VALVE ASSEMBLY

BACKGROUND OF THE INVENTION

The present invention relates generally to hydraulically operated elevators which are raised and lowered by an hydraulic ram assembly, and is particularly concerned with a control valve assembly for controlling the movement of such elevators.

Control valves for hydraulically operated elevators control the flow of hydraulic fluid into and out of the elevator cylinder in order to raise and lower the elevator. Typically, fluid is supplied to the cylinder from a pump in order to raise the elevator and the cylinder is connected to a reservoir to lower the elevator, the weight of the elevator car forcing fluid out of the cylinder when the cylinder is connected to the reservoir. However, if the pressure in the elevator cylinder is allowed to change suddenly, the resultant sudden movement of the elevator car will be uncomfortable to passengers. Similarly, sudden cut off of fluid supply to or from the cylinder will cause a sudden, jarring stop of the elevator car. Additionally, speed of movement of the elevator car will be dependent on the weight of passengers in the car if a simple on-off control valve is used.

In the past, complex control valves have been devised in attempting to overcome these problems.

SUMMARY OF THE INVENTION

It is an object of the present invention to provide a new and improved control valve assembly for controlling movement of an hydraulically operated elevator.

According to the present invention, a control valve assembly is provided, which comprises a first connecting passageway for connecting a pump output to an elevator cylinder, a check valve in the passageway movable between a closed position preventing reverse flow from the elevator cylinder when the pump is off, and an open position allowing fluid to flow from the pump into the elevator cylinder to raise the elevator car, a first valve unit for controlling the flow rate of fluid into the elevator cylinder to raise the elevator car, the first valve unit having a first outlet orifice for connection to a reservoir, a valve member for adjusting the size of the outlet orifice, and a first conduit connecting said passageway to said outlet orifice, whereby the size of said outlet orifice controls the flow rate of fluid into the elevator cylinder and thus the velocity of the elevator car, and a second valve unit for controlling the flow rate of fluid out of the elevator cylinder to lower the elevator car, the second valve unit having a second outlet orifice for connection to the reservoir, a second conduit connecting the cylinder to the outlet orifice, and a valve member for adjusting the size of the outlet orifice to control the flow rate of fluid out of the cylinder and thus the velocity of the elevator car.

Preferably, the first and second valve units are controlled by a controller responsive to detection of signals from the elevator controller regarding a selected direction in which the elevator is to be moved and to a feedback sensor detecting motion of the elevator car for controlling movement of the respective valve members so that the elevator velocity varies to follow a predetermined velocity curve independent of the load on the elevator car or variations in the fluid viscosity.

The requirements for moving the elevator car up according to a desired velocity profile are very different from those for moving the elevator car down, since in raising the car the load in the elevator car must be lifted, so that a higher pressure is needed in the elevator cylinder to raise the elevator at the same rate for a higher load than for a lower load. In lowering the car, it will tend to drop faster when the load in the car is higher, so that greater throttling of flow out of the cylinder is required to maintain the same elevator speed with a higher load than with a lower load. By providing separate valve units for controlling raising and lowering of the elevator car, the valve assembly can be simplified while still meeting these different requirements.

Preferably, the first and second valve units are provided in a single valve housing which has an inlet for connection to a pump and an outlet for connection to an elevator cylinder, a passageway or conduit connecting the inlet to the outlet, and a normally closed check valve in the passageway for preventing reverse flow through the passageway and to hold the car in place. The check valve divides the passageway into a first or pump chamber portion between the inlet and the check valve and a second portion or elevator cylinder chamber between the check valve and the outlet. The first valve unit communicates with the first portion or pump chamber of the passageway and the second valve unit communicates with the second portion or cylinder chamber of the passageway. The check valve is biassed into the closed position so that it will open only when the pressure differential between the first portion and second portion is sufficient to overcome the biassing force.

When the elevator car is stationary, the pump will be turned off, the first valve member will be fully open and the second valve member will be fully closed. If a control signal is received to move the car from its stationary position in an upwards direction, the pump will first be turned on. The first outlet orifice is fully or sufficiently open at this point, to allow the pump output to flow through the outlet orifice to the reservoir so that pressure will not build up sufficiently in the first portion of the passageway to open the check valve. The valve member will then be operated to reduce the size of the outlet orifice, throttling the flow of fluid to the reservoir. As a result of this, pressure in the first portion of the passageway will increase until it is sufficient to open the check valve, at which point fluid will be forced to flow into the elevator cylinder and the elevator car will start to move up. However, some fluid will still flow out through the reduced outlet orifice, and the elevator car will therefore start to move relatively slowly. The first valve member is then controlled according to a predetermined elevator velocity profile so as to gradually reduce the size of the outlet orifice, gradually increasing the flow rate into the cylinder and thus increasing the elevator velocity, until a maximum velocity is reached where the outlet orifice is fully closed. Then, as the elevator car approaches the desired destination, the valve member is controlled to gradually open the outlet orifice again, gradually reducing the elevator velocity until it comes to a stop at the floor, at which time the check valve again closes and the outlet orifice is fully or partially open. At this point the pump is turned off.

The valve member of the second or down valve unit is normally parked in a closed position in which the second outlet orifice is completely closed. When a control signal is received to move the elevator car from a parked position in a downwards direction, the valve member is controlled to move slowly from the closed position to gradually open the outlet orifice, allowing fluid to flow slowly out of the cylinder so that the elevator starts to move down relatively slowly. The down valve unit is controlled so that the elevator car velocity follows a predetermined elevator velocity profile, starting slowly and gradually speeding up to a maximum velocity when the down valve member is sufficiently open to permit the car to move at a predetermined maximum velocity. The maximum velocity permitted in the downwards direction may be higher than in the upwards direction to improve performance. The velocity is reduced again as the elevator car approaches the floor, with the valve member fully closing when the elevator car is at the floor. The feedback from the elevator motion sensor is used to adjust the size of the outlet orifice so that the same velocity profile will be followed regardless of load in the elevator or variation in fluid viscosity.

Preferably, both the up and down valve units have two chambers on opposite sides of the respective valve member, and pressure differential between the chambers is used to move the valve members between the open and closed positions. Suitable control members control supply of fluid to and from the chambers, such that a relatively small movement of the control member causes a large pressure change. In a preferred embodiment of the invention, each valve unit has a control spool extending through the valve member or piston and movable relative to the piston to control the size of an orifice connecting the chambers on opposite sides of the piston. The control spool is moved up or down in order to control the piston movement, which follows that of the control spool. This arrangement will minimize hysteresis and lag, since a relatively small movement of the control spool will cause a large pressure differential. Stepper motors are used to move the control spools, and are controlled to operate in micro-steps to produce small movements of the control spools, so that great precision can be achieved in controlling the elevator movement. Preferably, each control spool has opposite ends which project out through sealed openings in the respective valve units, so that there is little or no resistance to movement of the control spool.

In a preferred embodiment of the invention, each valve unit has a safety device for overriding the control members if the valve members should malfunction. Each safety device is controlled to move the respective valve member relatively quickly into the parked position in the event that such a malfunction is detected. For example, if the down valve member should malfunction when the elevator car is moving down at some velocity, the safety device will cut in and close the valve member, reducing the risk of the elevator car moving down to the end of its travel at some velocity, with potentially catastrophic results. Similarly, if the up valve member should malfunction when the elevator car is being driven up at some velocity, the safety device will be operated in order to open the valve member and stop the elevator car relatively quickly, reducing the risk of potential contact with an end stop or the like while travelling at some velocity.

This control valve assembly provides an accurate, relatively simply arrangement for controlling movement of an elevator car with precision to follow a desired velocity profile without jarring passengers when the elevator car starts from a parked position or when the car is stopped at a destination.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
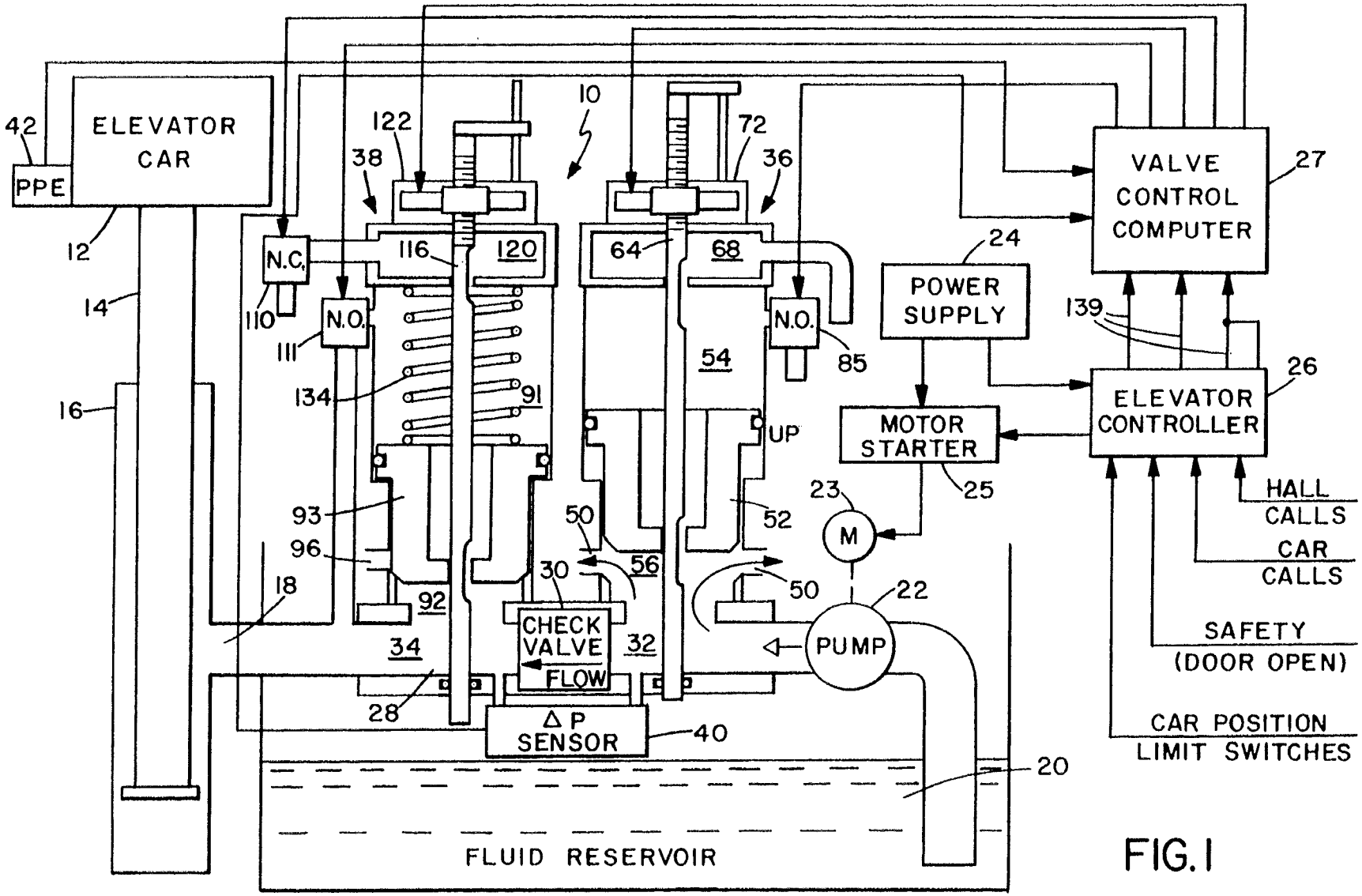
FIG. 1 illustrates schematically an elevator control system and control valve assembly according to a preferred embodiment of the present invention, with the elevator in stationary position.
Figure 2:
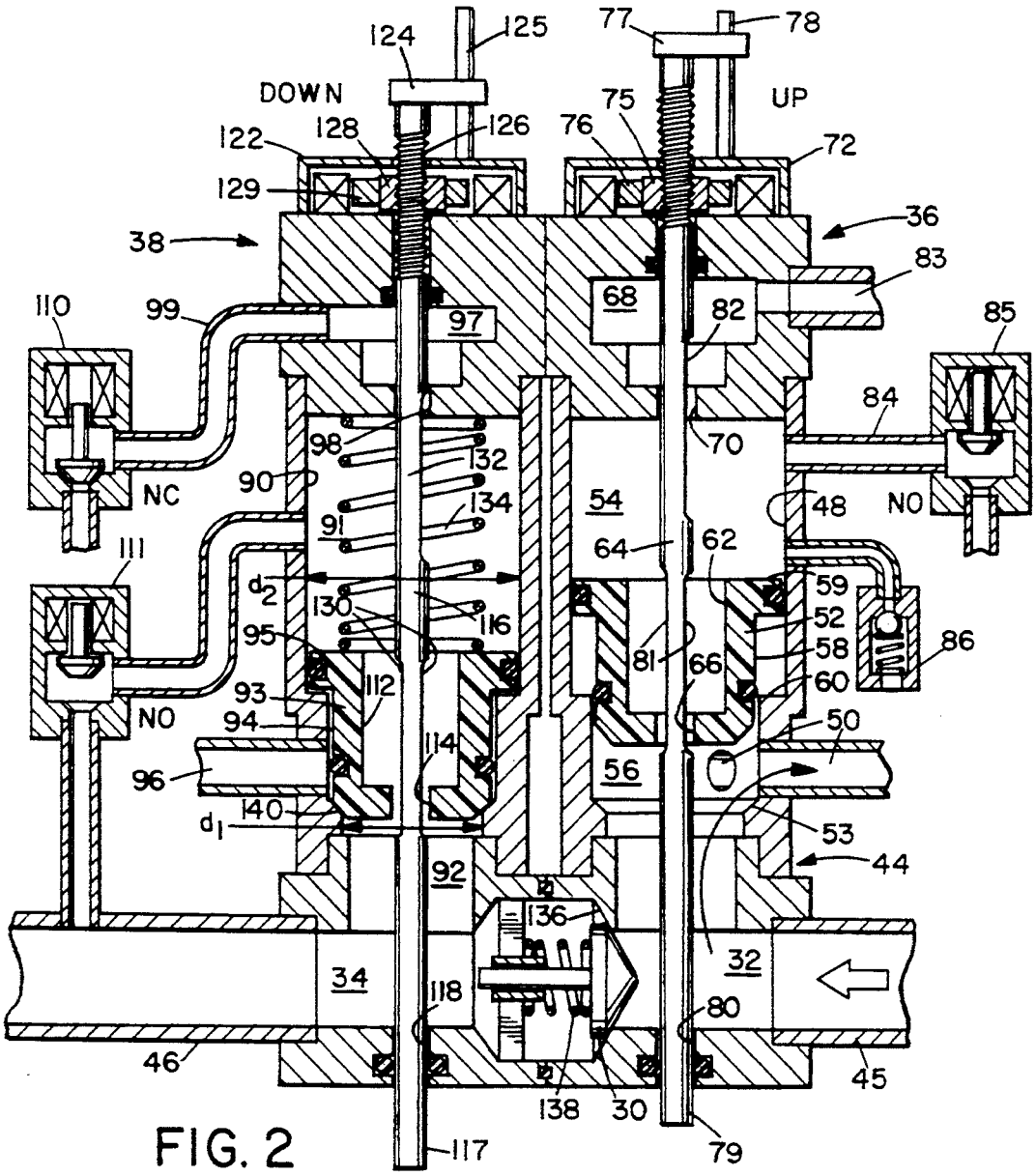
FIG. 2 is a diametrical sectional view of the control valve assembly.

FIG. 1 schematically illustrates an elevator motion control system incorporating a control valve assembly 10 according to a preferred embodiment of the present invention, while FIG. 2 illustrates the control valve assembly in more detail. Both FIGS. 1 and 2 illustrate the valve assembly in the parked position in which an elevator car 12 is stationary.

The control system as illustrated in FIG. 1 is used to control the motion of elevator car 12 in an elevator shaft (not illustrated). Movement of the car 12 is controlled by hydraulic ram 14 which extends upwardly out of elevator cylinder 16 and is connected to the elevator car as schematically illustrated in FIG. 1. Fluid is supplied to cylinder 16 via inlet opening 18 in order to move the ram 14, and thus the elevator car 12, upwardly. Fluid is allowed to return from cylinder 16 to a reservoir 20 via the opening 18, causing the elevator car 12 to descend. The reduction in pressure in cylinder 16 when the cylinder is connected to the reservoir will permit the weight in elevator car 12 to force the ram 14 downwardly into cylinder 16, in turn forcing more fluid out of cylinder 16 until the connection to the reservoir is cut off. Control valve assembly 10 controls the supply of fluid from a pump 22 to the cylinder 16 to raise the elevator and the supply of fluid from the cylinder to the reservoir to lower the elevator. Pump motor 23 is connected to power supply 24 via motor starter 25 which switches the pump motor on and off under the control of a conventional elevator controller or microprocessor 26.

Elevator controller 26 receives inputs from the manual control buttons in the elevator car itself (car calls), the control buttons at the various floor levels (hall calls), car position limit switches, and safety sensors such as the elevator car door sensors for detecting whether the car door is open or closed, as is conventional in the field. Controller 26 stores information on the current car position and the floor to which the elevator car is to be driven next, and provides corresponding outputs to the pump motor starter in order to turn the pump on and off when an elevator car is to be driven upwards. Controller 26 is also connected to a valve control computer or other type of controller 27 to provide control inputs 139 for controlling the valve assembly 10 in order to drive the elevator car to a selected destination.

The control valve assembly 10 includes a first passageway or conduit 28 between the pump 22 and the inlet opening 18 of the elevator cylinder. A one-way check valve 30 in passageway 28 divides the passageway into a first, pump-side chamber or portion 32 between the pump and check valve 30 and a second, cylinder-side chamber or portion 34 between the check valve and the elevator cylinder. A first or up valve unit 36 is connected to the first portion 32 of the passageway on the pump side of the check valve 30, and a separate second or down valve unit 38 is connected to the second portion 34 of the passageway on the cylinder side of check valve 30. Check valve 30 opens only in the direction of the arrow in FIG. 1 to allow flow from the pump 22 to the cylinder and to prevent flow in the reverse direction. The up valve unit 36 controls both the opening of check valve 30, by forcing fluid through the check valve, and the rate of flow of fluid into the cylinder. The down valve unit 38 controls the flow of fluid out of the cylinder. A sensor 40 senses the difference in pressure, $\Delta$ P, on opposite sides of check valve 30, and the output of sensor 40 is provided as an input to the valve control computer.

A conventional car position pulse encoder or PPE 42 on the elevator car 12 produces a set number of pulses per increment of travel of the car. The output of encoder 42 is provided as a car position feedback input to the valve control computer. This provides feedback of the actual movement of the elevator car in response to operation of the control valve assembly 10, and allows compensation for varying load in the car and varying viscosity of the operating fluid as a result of temperature change.

The control valve assembly 10 is illustrated in more detail in FIG. 2 and basically comprises an outer housing 44 through which passageway 28 extends, with an inlet 45 for connection to the output of pump 22, and an inlet/outlet 46 for connection to elevator cylinder 16. The first or up valve unit and second or down valve unit are of similar construction and operation. The first valve unit 36 basically comprises a cylinder 48 having several outlet orifices 50 connecting the pump to the reservoir, and a valve member or piston 52 slidably mounted in the cylinder to divide the cylinder into a separate lower or first chamber 56 and upper or second chamber 54. The outlet orifices 50 are located in the lower chamber 56, which is also connected to the first portion 32 of passageway 28 at a T-junction, so that the first portion 32 of the passageway and the lower or first chamber 56 of the valve unit form a single chamber.

Valve piston 52 is of stepped diameter, having a smaller diameter lower end portion 58 and a larger diameter upper end portion 59, which engage in the lower and upper chambers 56,54, respectively, which are of correspondingly stepped diameter with an annular step or shoulder 60 between the different diameter portions of cylinder 48. The piston 52 has a through bore 62 through which a control spool 64 extends. A smaller diameter orifice or portion 66 is provided at the lower end of through bore 62. A further, control chamber or path 68 to the reservoir is provided at the upper end of the cylinder 48, the control path or chamber 68 having an inlet orifice 70 communicating with the upper chamber 54 of the valve unit. The upper end of control spool 64 extends through orifice 70 and chamber 68 and through stepper motor 72 to project upwardly out of the upper end of the cylinder or housing. A threaded portion 74 of the control spool 64 engages a correspondingly threaded running nut 75 of stepper motor 72, which is rotated via rotor 76 when the stepper motor 72 is actuated.

Figure 3:
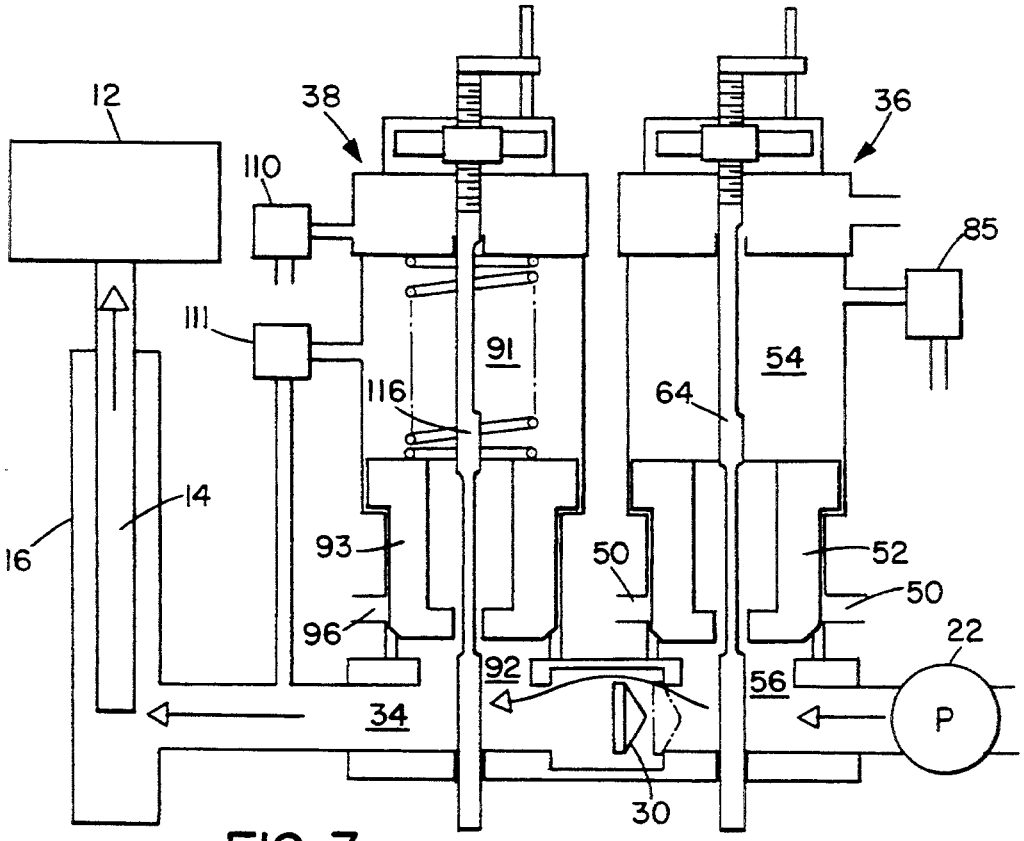
FIG. 3 is similar to a portion of FIG. 1, showing the valves in the elevator UP position.

The projecting upper end of spool 64 is connected to an alignment flange 77 which is slidably engaged on alignment post 78 at the upper end of the valve housing. Thus, actuation of rotor 76 will drive the spool 64 up or down between an upper, parked position as illustrated in FIG. 2 and a lowered position as illustrated in FIG. 3. The rotor 76 can be driven in micro-steps to move the spool to any position between the two extremes of its stroke illustrated in FIGS. 2 and 3. The design of the valve is such that the piston 52 will follow the movement of control spool 64, as will be explained in more detail below. Thus, piston 52 moves between the parked, upper position of FIG. 2 in which orifices 50 are fully or partially open and the lowermost position of its stroke as illustrated in FIG. 3 in which the orifices are fully closed and piston 52 is seated against seat 53. Although orifices 50 are illustrated to be fully open at the upper end of the piston stroke, in practice they may be partially open at this point to allow for some variation between different types of elevators. All that is necessary is that the opening be sufficient to allow all flow from the pump to return to the reservoir.

Operation of rotor 76 to move the control spool 64 up and down between its uppermost and lowermost positions is controlled by a control output from valve control computer 27, as schematically illustrated in FIG. 1. The lower end 79 of control spool 64 extends through a sealed opening 80 in the lower end of the valve housing 40 so that the spool is a frictional sliding fit in opening 80 and will substantially block leakage of any fluid from passageway portion 28. Since the opposite ends of spool 64 are not exposed to any of the pressures within the respective valve chambers, the spool will be freely slidable up and down with very little resistance to movement, and a relatively low force will be needed to drive the control spool 64 up and down, so that a relatively low power and low cost motor 72 may be used.

Control spool 64 is of diameter such that it is a close sliding fit through both orifice 70 at the top of upper chamber 54 and orifice 66 in piston 52. Spool 64 has a pair of opposing, elongated notches or recesses 81 at a first region in its length which will normally extend through piston orifice 66. A further, single notch 82 is provided at a location above recesses 81 which will normally extend through orifice 70 connecting upper chamber 54 to control chamber 68. Thus, the size of orifice 66 will be determined by the position of notches 81 relative to orifice 66, while the size of orifice 70 will similarly be determined by the location of notch 82 relative to orifice 70. The relative positions of notches 81 and orifice 66 and notch 82 relative to orifice 70 when the up valve unit is in the uppermost, parked position are illustrated in FIG. 2. Thus, in this position, the lower ends of notches 81 are located adjacent the lower end of orifice 66, so as to slightly constrict this orifice, while a central portion of notch 82 is aligned with orifice 70, so that this orifice is at its maximum opening. The length and position of notch 82 is such that orifice 70 will remain at the same effective area during at least the majority of the stroke of control spool 64, while the notches 81 are dimensioned and positioned to vary the area of orifice 66 during the stroke of the control spool, as will be explained in more detail below. Thus, notches 81 are dimensioned to taper between a minimum and maximum depth along the length of the slot. In one specific example, where the control spool diameter was ¼", the notch 81 varied in depth from one end up to 3/32" in depth at the center of the notch, in a length of 3/10". Orifices 66 and 70 will be self-cleaning due to the sliding of control spool 64 through the orifices, which will tend to dislodge any debris.

Chamber 68 has a drain or vent outlet 83 to the reservoir 20. The upper valve chamber 54 has a safety outlet 84 connected to normally open solenoid valve 85. Solenoid valve 85 will be open to allow fluid to drain from chamber 54 to the reservoir whenever the system is off or parked and also whenever an emergency situation or valve malfunction is detected, as will be explained in more detail below. A control output from valve control computer 27 is also connected to solenoid safety valve 85, as illustrated schematically in FIG. 1. A pressure relief valve 86 is also connected to chamber 54.

The down valve unit 38 is in some respects identical to the up valve unit. Thus, down valve unit 38 also comprises a cylinder 90 of stepped diameter forming a lower or first chamber 92 of smaller diameter and an upper or second chamber 91 of larger diameter separated by stepped diameter valve piston 93 having a smaller diameter end portion 94 running in chamber 92 and a larger diameter end portion 95 running in upper chamber 91. Lower chamber 92 has one or more outlets or drain orifices 96 for fluid to drain from chamber 92 into the reservoir 20 whenever the valve is fully or partially open. One or more outlet orifices 96 will be provided, but the outlet orifices for the down side of the valve assembly will be smaller than the orifices on the up side. Lower chamber 92 is also connected to the second portion 34 of passageway 28, to the left of check valve 30 as illustrated in FIG. 2, via a T-junction.

The valve unit 38 also has an upper control chamber 97 connected to upper chamber 91 via orifice 98, and a safety outlet 99 from chamber 97 is connected to a normally closed solenoid valve 110 which forms part of a safety valve for the down valve unit. A second solenoid safety valve 111 is connected between passageway 34 and valve chamber 91. Solenoid valve 110 will be normally closed and valve 111 will be normally open when the valve assembly is inoperative or parked, as illustrated in FIG. 2. Valve 110 will be closed and valve 111 will be opened automatically when an unsafe condition or malfunction is detected, as will be explained in more detail below. Valves 110, 111 also have a control input from valve control computer 27. When valve 110 is closed and/or valve 111 is open, the piston 93 cannot open.

As in the up valve unit, the down valve piston 93 has a through bore 112 with a reduced size orifice 114 at its lower end controlling connection between upper and lower chambers 91,92. A control spool 116 extends through orifice 114 to control the size of the orifice, and the lower end 117 of spool 116 projects out through a sealed opening 118 in housing 44. The upper end of the spool 116 extends upwardly through orifice 98, chamber 97, and stepper motor 122, with the upper end of spool 116 having a transverse alignment flange or bracket 124 slidably engaged over alignment post 125 on top of the valve housing, as with the up valve unit. Control spool 116 has a threaded portion 126 extending through stepper motor 122 to engage running nut 128 which is rotated by rotor 129 to move the spool up and down between the lowermost, parked position illustrated in FIG. 2 and the uppermost position of the spool stroke, which is illustrated schematically in FIG. 4. Operation of stepper motor 122 is also controlled by the valve control computer 27 via a control input as illustrated in FIG. 1, and computer 27 is programmed to move the spool 116 in micro-steps to any position between the opposite ends of the stroke illustrated in FIGS. 2 and 4. Again, since the opposite ends of the spool 116 are not located in any pressure chambers but are outside the valve housing and exposed to atmospheric pressure, very little force will be needed to drive spool 116 up and down, and thus a relatively low power stepper motor 122 can be used.

Figure 4:
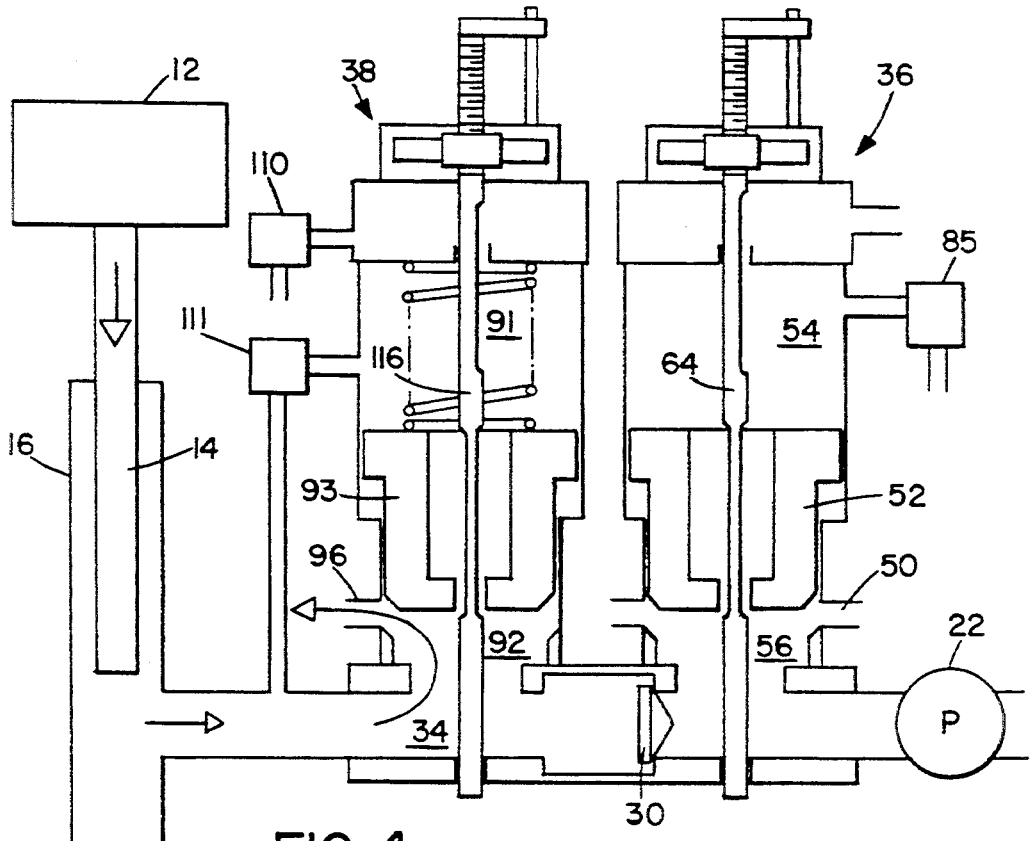
FIG. 4 is similar to FIG. 3, with the valves in the elevator DOWN position.

Spool 116 has a pair of opposing, elongated notches or recesses 130 positioned for extending through orifice 114 so as to control the area of orifice 114 depending on the position of spool 116. A single elongated notch 132 above notches 130 is positioned to control the area of orifice 98 connecting the upper chamber 91 to control chamber 97. As illustrated in FIG. 2, when spool 116 is in the lowermost or parked position, the upper end of notch 132 is below the upper end of orifice 98 so that this orifice is effectively closed and little flow can take place between chambers 91 and 97. The notches 130 extend through orifice 114 so that this orifice is fully open. In the uppermost position notch 132 will be raised as illustrated in FIG. 4 to a position in which the orifice 98 is open, while notches 130 will be positioned with their lower ends starting to close orifice 114. As with the up valve unit, orifices 98 and 114 are self-cleaning.

Unlike the up valve piston, the down valve piston is biassed via biassing spring 134 towards the lowermost position illustrated in FIG. 2 in which piston 93 is seated against seat 140. In the lowermost position, outlet or orifice 96 will be completely covered and closed by piston 93. In the uppermost position of piston 93, orifice 96 is completely or sufficiently open to allow fluid to drain from elevator cylinder 16 through passageway portion 34, chamber 92 and orifice 96 into the reservoir. In practice, the uppermost end of the piston stroke may be adjusted to vary the maximum elevator velocity, so that orifice or orifices 96 will not be fully open at the end of the piston stroke.

Preferably, both the up and down valve pistons are of plastic material so that they will form a leak-tight seal against their respective valve seats when in the closed position, forming a seal against any fluid flowing past the pistons into the respective drain outlets.

The one-way check valve 30 is also illustrated in more detail in FIG. 2. Check valve is biassed against valve seat 136 by biassing spring 138 so as to close the passageway 28 and prevent reverse flow of fluid from the cylinder. The valve 30 can only be opened when the pressure to the right of the check valve, in the pump-side chamber formed by passageway portion 32 and the connected lower chamber 56 of the up valve unit, is greater than the pressure to the left of the check valve, in passageway portion or cylinder-side chamber 34, by an amount sufficient to overcome the biassing force of spring 138. As noted above, sensor 40 detects the difference, $\Delta$ P, between these pressures. Check valve 30 is preferably of plastic material so that it will also form a leak-tight seal against the metal seat without needing any additional seals built into the valve.

Figure 6:
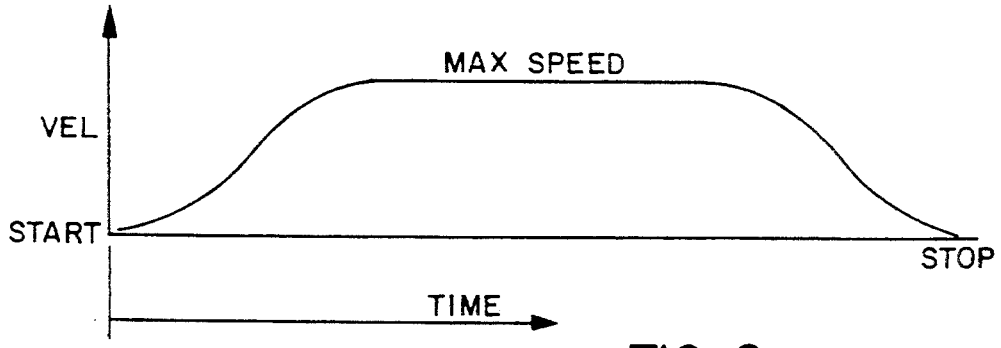
FIG. 6 is a graph of the preferred velocity profile of elevator motion.

The operation of the up and down valve units to drive the elevator car up and down in order to move it from a parked position to a selected floor will now be described in more detail. It is desirable, when moving an elevator car, that it starts to move relatively slowly from a parked position, gradually building up speed to a maximum velocity, and that the velocity slows down or decelerates gradually from the maximum velocity to zero as the car approaches the selected landing destination. FIG. 6 illustrates a preferred elevator car velocity profile from a start or rest position to a stop position. As illustrated in FIG. 6, the car accelerates gradually up to a maximum velocity, travels at this maximum velocity until it is a predetermined distance away from a selected floor, and then decelerates gradually down to a full stop at the floor. This ensures that passengers will not be jolted or jarred by sudden starts or stops in normal operation of the elevator. The valve control computer is programmed to operate the valve stepper motors 72,122 so that the elevator follows a predetermined velocity profile, such as that illustrated in FIG. 6, when moving up or down between floors. In practice, different velocity profiles may be used for up and down travel of the elevator. The input from the position pulse encoder 42 will provide a position feedback to allow the computer to check whether the elevator car is following the velocity profile, and, if not, to vary the valve opening to correct any variation, or, if unsafe condition is detected, to operate the respective safety valves in order to stop the car in an emergency situation.

As noted above, the elevator controller 26 is a conventional controller connected to receive various inputs from elevator car position switches, safety switches, hall calls from passengers at elevator car levels requesting an elevator, and car calls from passengers in an elevator indicating which floor they wish to travel to. In a conventional manner, this controller takes all of the input information, and produces conventional output control signals 139 for controlling elevator movement. These output control signals are: Up level, up high speed, up inspect speed, down level, down high speed, down inspect speed. Two output control signals will be output from the controller 26 whenever the elevator car is to be moved to a higher or lower floor. In the case of a higher floor, the signals "up level" and "up high speed" are output together. The two signals "down level" and "down high speed" are produced in order to move the elevator towards a lower floor. At a predetermined distance from the desired floor, the controller will drop the "up high speed" or "down high speed" signal.

The output control signals 139 are input to the valve control computer, which operates the control valve assembly 10 according to the input from the elevator controller. The valve controller is programmed to operate the up and down valve units to move the elevator car as illustrated schematically in the flow diagram of FIG. 7. The controller will move the car upwardly according to the profile in FIG. 6 when it receives "up level" and "up high speed" inputs from the elevator controller. When the elevator controller 26 determines that the elevator car is approaching the desired floor, the "up high speed" signal is dropped. The valve controller responds by operating the valve to start slowing down the elevator. At the floor, the remaining up or down level signal is dropped and the elevator is stopped. Similarly, the valve control computer operates down valve unit 38 to move the elevator downwardly on receiving both "down level" and "down high speed" inputs, according to the desired profile, slowing down from maximum speed when the "down high speed" input drops out, and stopping at the floor when the "down level" signal is dropped. The up inspect speed and down inspect speed inputs are used only for elevator maintenance purposes.

As mentioned above, when the elevator car is parked in a stationary position, (step 170 in FIG. 7) the valve assembly 10 will be in the parked position illustrated in FIG. 2. Check valve 30 will be closed, and down piston 93 will cover orifice 96 so the pressure in region 34 will correspond to the pressure in the elevator cylinder. The pressure in upper chamber 91 together with the biassing force of spring 134 will be sufficient to hold the piston 93 in the lowermost position in which it seats against seat 140 to block flow of liquid through orifice 96. Because orifice 114 is at its maximum opening and orifice 98 is closed, the pressure in chamber 91 will be substantially equal to that in chamber 92. However, since the diameter d2 and thus the area A2 of the top of the piston is greater than the diameter d1 and area A1 of the lower end of the piston, the force F2 on the upper end of the piston due to the pressure of fluid in chamber 91 will be greater than the force F1 on the lower end of the piston, so that there will always be a high net downwards force on the piston when the pressure in chambers 91 and 92 is equal.

If the car 12 is to be moved down from a parked position to a lower floor, valve control computer 27 will receive a "down level" and "down high speed" input (step 172 in FIG. 7) from controller 26. The stepper motor 122 will be actuated (step 174) in order to move the control spool 116 gradually upwardly (step 176). As the control spool moves upwardly, notches 130,132 will also move upwardly, gradually pinching off orifice 114 in the piston while opening up the orifice 98 between chamber 91 and upper control chamber 97. As long as the lower orifice opening is larger than the top orifice opening, there will be more pressure drop across orifice 98 than 114 and the pressure in chamber 91 will-not drop enough to move piston 93. However, as the spool 116 continues to move up, the bottom orifice opening will gradually become smaller than the top orifice opening, at which point the pressure in chamber 91 will decrease further. Once the pressure in chamber 91 is low enough, the pressure in chamber 92 overcomes the net downwards force resulting from biassing spring 134 and the differential piston area, and piston 93 will start to move up, following or tracking the movement of spool 116. At this point fluid can flow out of elevator cylinder 16 at a rate controlled by the size of the orifice 96, and thus the position of piston 93, as well as the load on elevator car 12 and fluid viscosity, and the elevator car will start to move downwardly. The valve control computer will automatically adjust the orifice opening 96 (step 180 in FIG. 7) according to feedback input from the position pulse encoder 42 so that the velocity profile substantially follows that illustrated in FIG. 6 (step 182 in FIG. 7). Thus, if the elevator car should start falling at a higher speed due to higher weight or load on the car, or lower fluid viscosity the orifice opening will be reduced in order to follow basically the same profile regardless of weight in the elevator car and variation in fluid viscosity.

The stepper motor is controlled to adjust orifice opening 96 gradually so that the elevator car slowly builds up speed to a maximum velocity (step 184) as illustrated in FIG. 6, at which point orifice 96 will be open sufficiently to obtain the desired maximum velocity which will not normally be at the maximum opening illustrated in FIG. 4 which would occur only under unusual operating conditions. At a predetermined distance from the selected floor, based on the input from elevator controller 26 (step 186), the control spool is moved slowly back down to gradually open up piston orifice 114 (step 188), until the pressure differential is such that piston 93 is forced down to track the control spool and gradually pinch off the orifice 96 to the reservoir. The computer compares the feedback input from the PPE 42 to the desired deceleration profile in FIG. 6, in steps 189 and 190, in order to adjust the control spool so that the elevator velocity follows the deceleration part of the desired profile illustrated in FIG. 6 and stops at the floor level (step 192), without a period of slow constant speed as is standard in prior art hydraulic elevator systems.

Considering now the control of up valve unit 36 to move the elevator car to a higher floor from a parked position, up valve unit 36 will initially be in the parked position illustrated in FIG. 1. Outlet or drain orifices 45 will be at least substantially open, as will be the safety valve 85 connecting chamber 54 to the reservoir. The control spool 64 will be in the position illustrated in FIG. 2. The pump will be off, so that the pressure to the right of check valve 30 will be essentially zero, and the pressure to the left of the check valve, which is equivalent to the working pressure in the elevator cylinder, will hold the valve 30 closed. When a signal is received by the elevator controller 26 that the elevator is to be moved to a higher floor, appropriate up level and up high speed control signals are provided to the valve control computer 27 (step 193) in order to actuate stepper motor 72 (step 194) and operate the valve unit 10 so as to supply fluid to the elevator cylinder in a manner that raises the elevator car according to the velocity profile of FIG. 6.

The computer 27 will actuate safety solenoid valve 85 in order to close the valve, and controller 26 will actuate pump 22 (step 195). Initially, since the outlet orifices 50 are open and the check valve is closed, the entire flow of fluid from pump 22 will be dumped to the reservoir. However, at the same time, the up valve stepper motor 72 is actuated in order to drive the spool 64 downwards. As the spool 64 moves down, the size of the orifice connecting chambers 54 and 56 will increase, increasing pressure in upper chamber 54. The size of the top orifice 70 does not change with the stroke of spool 64 until spool 64 is fully down. Thus, there will be a greater pressure drop across orifice 70 than across orifice 66, and the pressure in chamber 54 will rise further. Because of the difference in area between the top and bottom of piston 52, the piston is in balance when pressure in chamber 54 is less than that in chamber 56. As pressure in chamber 54 rises, there will be a net force on the piston in a downwards direction and the piston 52 will start to move down, following spool 64, and the outlet orifices 50 will be reduced in size, increasing the pressure on the right of check valve 30. When the pressure to the right of check valve 30 is sufficient to overcome the opposing pressure and the biassing force of spring 32, check valve 30 will be forced open and fluid will flow through cylinder inlet 46 into the elevator cylinder, and the ram will be forced upwards at a velocity dependent on the flow rate into the elevator cylinder.

Figure 7:
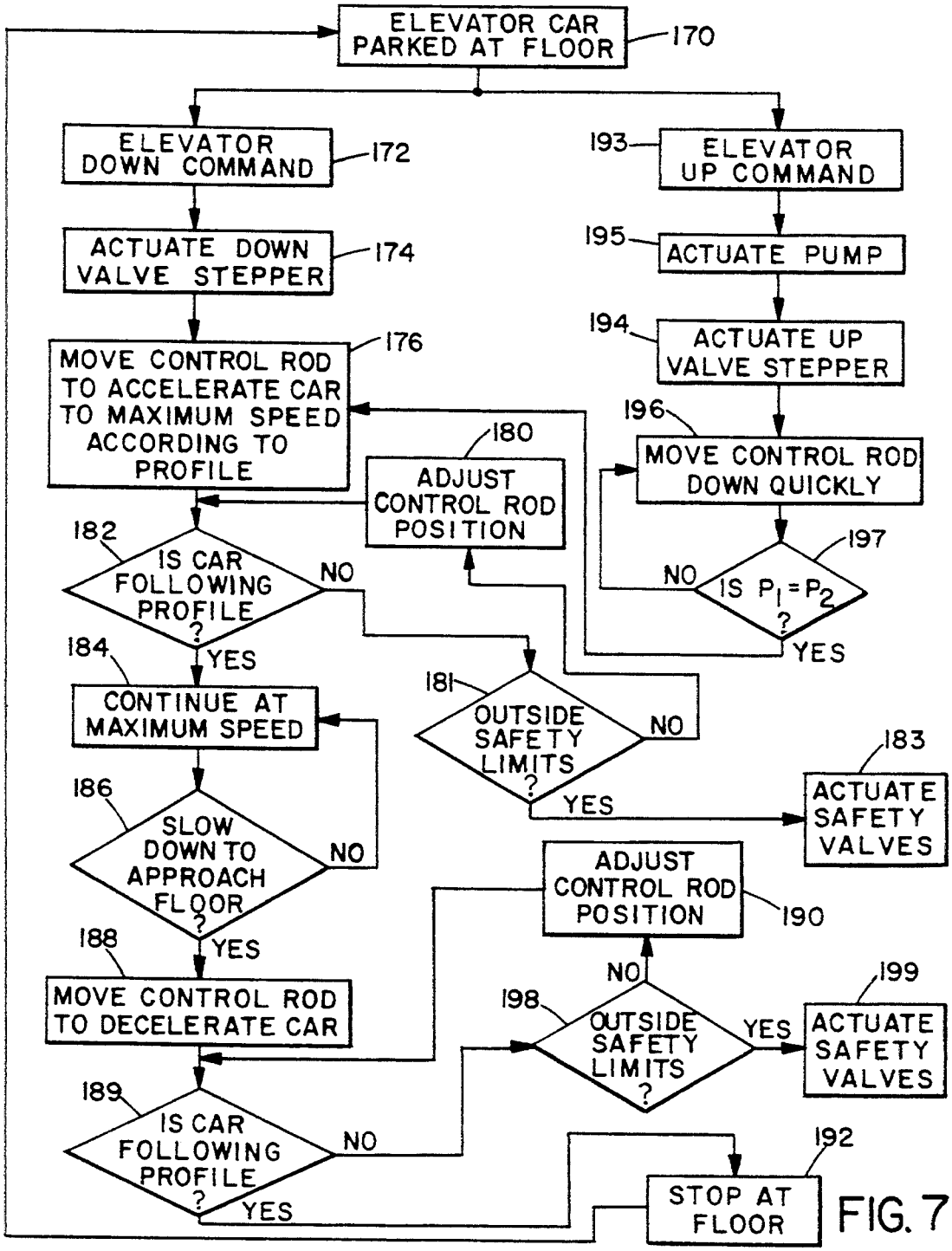
FIG. 7 is a schematic flow diagram of the control valve operation.

As noted above, sensor 40 detects the difference between the pressures P1 and P2 on opposite sides of the check valve, and this difference is provided as a control input to the valve control computer 27. The computer 27 operates stepper motor 72 to drive the spool 64 down relatively quickly until the pressures are equalized (steps 196,197), and then starts to operate the spool 64 according to the velocity profile of FIG. 6, in a similar manner to the down valve operation, as indicated in FIG. 7. This is because the up movement will not begin until the pressure P1 is sufficient to open valve 30, and it is therefore necessary to drive the up valve quickly to this point so that passengers in the elevator do not experience a long delay. When the valve 30 opens, the up movement will start and the valve opening must then be controlled such that the elevator car is moved according to the profile of FIG. 6 using the feedback input from PPE 42. Thus, the purpose of sensor 40 is to let the computer know when to start operating the valve according to the velocity profile.

Once valve 30 is open, the flow rate into the elevator cylinder will be dependent on the size of outlet orifices 50, which in turn is dependent on the position of piston spool 64 and thus piston 52. When the orifices 50 are fully closed, as illustrated in FIG. 3, all fluid will flow into the elevator cylinder and the ram and elevator car will be urged upwards at maximum speed. This is referred to as "contract speed" and is dependent on the pump maximum flow and ram diameter. The computer 27 therefore moves the spool 64 so as to shut off orifices 50 gradually at first, so that the elevator car starts to move slowly. The spool 54 is moved down so that the flow into the elevator cylinder increases up to the maximum speed of FIG. 6. The size of orifices 50 is adjusted depending on feedback from the PPE sensor 42, so that the profile is followed regardless of load on the elevator car or fluid viscosity. At a predetermined distance from the selected floor, the spool 54 is moved upwards again, reducing the orifice connecting chambers 54 and 56 and thus reducing pressure in chamber 54 so that the piston 52 also moves up, starting to open the drain orifices 50 again. Some flow will then be diverted to the reservoir, and the elevator car will start to slow down, gradually returning to a stop at the floor when the orifices 50 are sufficiently open, at which point the check valve 30 will close to hold the car. The pump is turned off, and the safety valve 85 is again opened.

Figure 5:
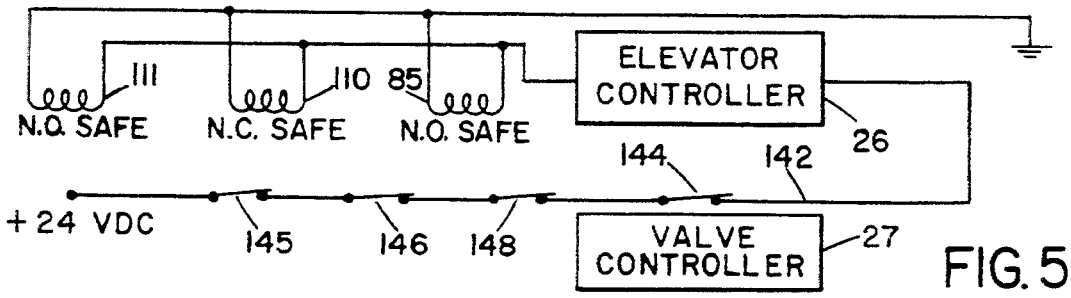
FIG. 5 is a wiring diagram of the safety and control switches.

In the event of a malfunction, the solenoid safety valves 85, 110 and 111 will ensure that the elevator car is brought safely to a stop. These valves are connected to a conventional elevator safety string 142 of switches as illustrated in FIG. 5, such that power to the solenoid valves 85,110 and 111 is cut off if any of the switches in the safety string is open. The down safety valve 110 will be closed when no power is supplied to the solenoid, the valve 111 will be open, and the up safety valve 85 will normally be open when no power is supplied. During normal operation in driving the elevator car up or down, power is supplied to these valves so that the up safety valve 85 and down safety valve 111 are closed and the down safety valve is open. If any malfunction is detected causing any one of the string 142 of safety switches to open, power to valves 85, 110 and 111 will be cut off, opening valves 85 and 111 and closing valve 110. One safety switch 144 is controlled by the valve control computer 27. The valve control computer 27 at all times receives inputs from the position pulse encoder 42 on the elevator car. If it is determined that the elevator car is not following the velocity profile of FIG. 6 when the car is being driven up or down in the acceleration or deceleration part of the profile, and the variation is outside safety limits (steps 181, 198, respectively, in FIG. 7) the computer 27 will cause switch 142 to open, cutting off power to solenoid valves 85, 110 and 111 and causing them to move to their safe conditions, i.e. open in the case of valves 85 and 111 and closed in the case of valve 110 (steps 183, 199, respectively, in FIG. 7).

Other safety switches in string 140 are of a conventional type, for example switch 145 may be an emergency switch operated by elevator passengers, switch 146 may be a door switch to detect if the car door is jammed open, and switch 148 may be a hall door switch to detect if a hall door at an elevator floor for access to an elevator shaft is opened. Other safety switches may be provided as necessary.

If the valve control computer 27 determines from the input from car position pulse encoder 42 that the car is not following the acceleration or deceleration part of the velocity curve of FIG. 6, in spite of the computer 27 providing input to the appropriate stepper motor to move the respective control spool in a direction to vary the velocity of the elevator, this may indicate a malfunction in the stepper motor or that the control spool is not following the command, for example. If no safety valve were provided for such a situation, the elevator car would continue to be driven at relatively high speed to the end of its travel, with possibly disastrous consequences. Consider first the situation where the elevator car is being driven down at high speed with the down valve in the substantially open position, as illustrated in FIG. 4, so that fluid is being allowed out of the elevator cylinder through outlet 96 to the reservoir. Once the unsafe condition is detected, valve control computer 27 operates to open switch 144, and down safety valve 110 will be closed. This effectively seals the outlet from chamber 91 via orifice 98 and chamber 97. Simultaneously, valve 111 is opened, connecting chamber 91 to the cylinder. Fluid will flow through orifice 114 in piston 93 into chamber 91, and past open valve 111, and the pressure in chamber 91 will start to build up again. The pressure in chamber 91, together with the action of biassing spring 134, will be enough to force the piston 93 down into the closed position, sealing outlet 96 and stopping the elevator car relatively quickly.

Similarly, if the elevator car is being driven upwards and fails to slow down in spite of appropriate control inputs to the valve assembly 10 from the valve control computer 27 to move the control spool 54 up, this means that the spool 54 is not following the command, the stepper motor 72 has failed, or some other malfunction has occurred. In this event, control computer 27 will operate to open the switch 144, cutting off power to solenoid valve 85, which will open, allowing fluid to drain from chamber 54. The pressure in chamber 54 will fall, and the pressure differential between chambers 54 and 56 will then be sufficient to force piston 52 upwardly, opening outlets 50. The pump output will therefore be diverted to the reservoir, and valve 30 will close. The elevator car will therefore be brought to an halt relatively quickly.

Figure 8:
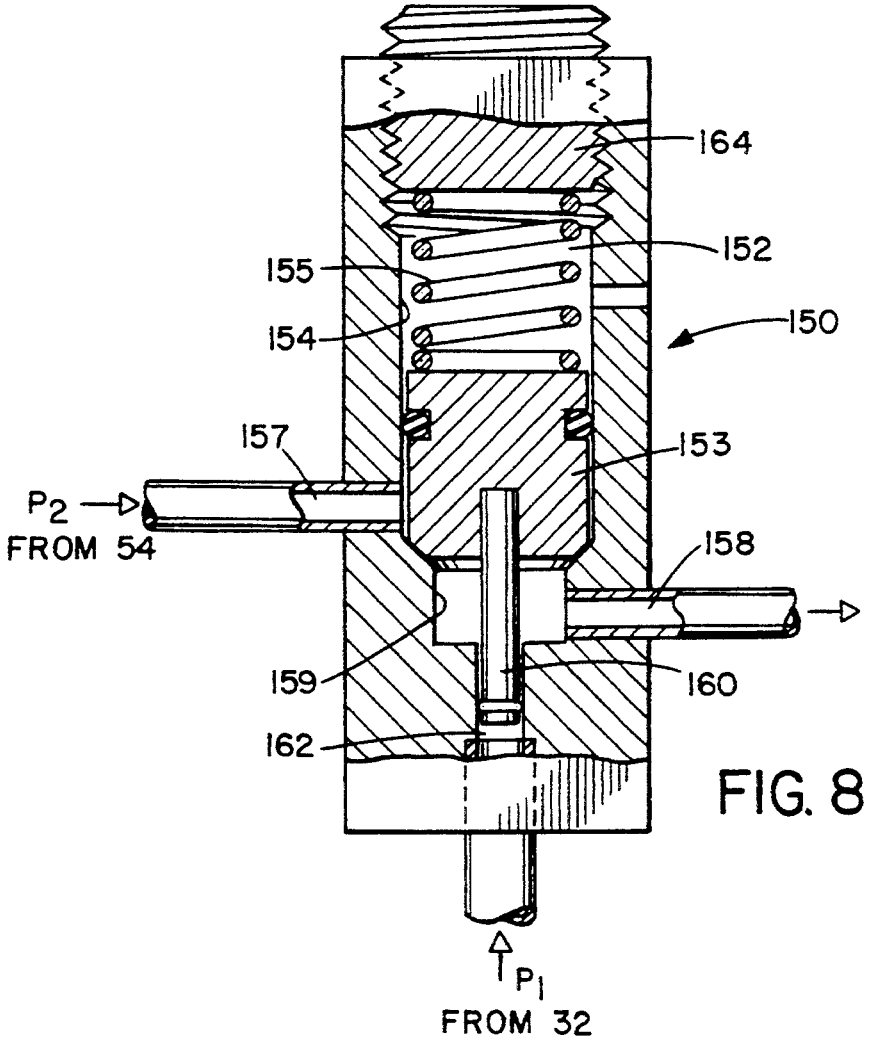
FIG. 8 is a sectional view illustrating a modified pressure relief valve for the up valve unit.

Pressure relief valve 86 is a conventional type of relief valve used in hydraulic systems to provide a pressure relief pathway in the event of a blockage in the system, avoiding pump overload. FIG. 8 illustrates a modified pressure relief valve 150 for allowing more efficient operation in the up cycle. In the operation described above, the up valve stroke is such that the upper orifice 70 between chambers 54 and 68 is always open, even at the lower end of the stroke when the piston is seated against seat 53. However, since the upper chamber 54 is connected to an output port 83 to the reservoir via orifice 70, some of the flow from the pump will be diverted out via orifices 66,70 and port 83 to the reservoir, resulting in waste of operating fluid. It would be more efficient if the orifice 70 could be closed at this point, and thus the down valve unit is preferably operated so that the spool or control spool 64 is driven downwardly beyond the point illustrated in FIG. 3 until the upper orifice 70 is just closed. With pressure relief valve 86 connected to the chamber 54 in this situation, valve 86 would simply open due to pressure build up in the chamber 54 when orifice 70 was closed, so that the same fluid wastage would occur. Thus, FIG. 8 illustrates an alternative pressure relief valve 160 for use when the system is operated to close upper orifice 70 when the elevator is to be driven upwardly at a maximum velocity.

Pressure relief valve 150 comprises a housing having a stepped through bore 152 with a valve piston 153 slidably mounted in a larger diameter portion 154 of the bore and biassed by adjustable spring 155 against valve seat 156. A pilot inlet 157 connected to chamber 54 is connected to the larger diameter portion 154 of the bore, and is blocked by piston 153 in the illustrated closed position of valve piston 153. A reservoir outlet 158 is connected to a smaller diameter portion 159 of the bore downstream of valve seat 156. A smaller diameter extension 160 from piston 153 extends through bore portion 159 and into the smallest diameter end portion 162 of bore 152, which is connected to the pump output or pump-side chamber 32. The spring pressure is adjusted via adjustment screw 164 such that the valve piston 153 will be opened if pressure in chamber 32 should rise above a predetermined level, indicating a blockage. Rise in pressure in chamber 54 will not affect piston 153 since it does not act on the end of the piston. In the event of a blockage, the resultant rise in pressure in portion or chamber 32 will push the valve piston upwards, opening inlet 157 so that fluid can flow from chamber 54, through inlet 157 and bore 159 into reservoir outlet 158. This arrangement allows upper orifice 70 to be closed when the elevator is being driven up at maximum velocity, and avoids wasting operating fluid in this situation.

The control valve assembly 10 allows movement of the elevator car to be controlled with precision and with little or no hysteresis. Because movement of relatively large pistons is controlled by pressure differentials, rather than by directly driving the pistons themselves up and down, relatively low power stepper motors may be used for controlling valve opening, and the motors may be moved in micro-steps for extremely accurate control of the elevator velocity. The differential area of the pistons ensures that there is little or no lag or hysteresis, since a very small movement of the control spool will cause a large force differential between the top and bottom faces of the valve piston, causing the valve pistons to follow the control spools quickly with very little lag time or error. The control spools are exposed to atmospheric pressure at their opposite ends, so there is no pressure-caused force to overcome, and there is little or no frictional resistance, so that very little force is needed to move the control spools up and down, as compared to the force which would be needed to move the valve pistons up and down directly. This allows great precision and accuracy in controlling the valve openings, and thus the elevator velocity. The elevator can therefore be controlled to follow a desired velocity profile with great precision.

By providing completely separate up and down control valves on opposite sides of the check valve, up and down movement can be both controlled and overridden independently and operation can be made safer and more accurate. The solenoid safety valves can be controlled independently and operated quickly to stop the elevator car regardless of whether it is moving upwards or downwards when an unsafe condition is detected.

Although a preferred embodiment of the present invention has been described above by way of example only, it will be understood by those skilled in the field that modifications may be made to the disclosed embodiment without departing from the scope of the invention, which is defined by the appended claims.

I claim:

1. A control valve assembly for controlling movement of a hydraulically operated elevator having a hydraulic cylinder and a ram in the cylinder for moving an elevator car up or down depending on hydraulic pressure in the cylinder, comprising:

a passageway for connecting a supply of hydraulic fluid to an elevator cylinder;

a check valve in the passageway for normally blocking the passageway when the elevator is parked or moving downwards, the check valve dividing the passageway into first and second portions on opposite supply and elevator cylinder sides, respectively, of the check valve, the check valve being movable between a normally closed position when the elevator is parked or moving downwards and an open position when the elevator is to be moved upwards;

a first valve control unit for controlling upwards movement of the elevator having a chamber connected to the first portion of the passageway, the chamber having an outlet orifice for connection to a reservoir and a valve member for controlling the size of the outlet orifice, the size of the outlet orifice determining the amount of fluid flowing from said passageway to the reservoir and thus the amount of fluid supplied to the elevator cylinder, the valve member being movable between an at least partially open position in which all fluid is diverted to the reservoir and a closed position in which all fluid is supplied to the elevator cylinder;

a second valve control unit separate from said first valve control unit for controlling downwards movement of the elevator, the second valve control unit having a chamber for connection to the elevator cylinder, the chamber of the second valve control unit having an outlet orifice for connection to a reservoir, and a valve member for controlling the size of the outlet orifice, the size of the outlet orifice determining the rate of flow of fluid out of the elevator cylinder to the reservoir to lower the elevator, and the valve member being movable between a closed position in which no fluid is drained from the elevator cylinder and an at least partially open position in which the rate of flow of fluid out of the cylinder is at a selected maximum value; and control means for controlling opening of said check valve and movement of said first and second valve members to move an elevator upwardly and downwardly.

2. The assembly as claimed in claim 1, wherein the chamber inlet of the second valve control unit is connected to the second portion of the passageway on the opposite side of the check valve to the first valve control unit.

3. The assembly as claimed in claim 1, wherein each valve unit comprises a cylinder, said valve member comprising a piston slidable in said cylinder and separating said cylinder into first and second chambers, the first chamber comprising the chamber having said outlet orifice so that the pressure in the first chamber of the up valve unit is equal to the pressure in the first portion of said passageway and the pressure in the first chamber of the down valve unit is equal to the pressure in said elevator cylinder, and flow varying means for varying the hydraulic pressure in each said second chamber to control the position of said piston in said cylinder, said control means controlling said flow varying means of each valve unit to control the position of said pistons and thus the size of said outlet orifices.

4. The assembly as claimed in claim 3, wherein each piston has a variable connecting orifice for connecting the first and second chambers so as to allow fluid to flow from the first to the second chamber at a rate dependent on the size of the connecting orifice, and the second chamber of each valve unit has an outlet control orifice for controlling flow of fluid out of the respective second chamber, and said flow varying means comprises a control member for controlling the size of said variable connecting orifice, the pressure in each said second chamber being dependent on the relative sizes of said connecting and control orifices.

5. The assembly as claimed in claim 4, wherein the control member of each valve unit comprises a control spool extending through said connecting orifice, said control means comprising drive means for driving said control spool in opposite directions through said connecting orifice, and said control spool having at least one recess of varying cross-section for varying the effective size of said connecting orifice depending on the position of said recess relative to said connecting orifice.

6. The assembly as claimed in claim 5, wherein each control spool has opposite ends extending out of opposite ends of the respective valve cylinder, and said drive means is linked to one end of said control spool, whereby there is substantially no resistance to movement of said control spool to control pressure in said second chamber.

7. The assembly as claimed in claim 5, wherein each drive means comprises a stepper motor for moving the respective control spool in micro-steps.

8. The assembly as claimed in claim 5, wherein said control spool of each valve unit also extends through said outlet control orifice and comprises means for controlling opening and closing of said control orifice.

9. The assembly as claimed in claim 1, including a first safety means connected to said first valve unit for automatically moving said valve member to a said at least partially open position on detection of an unsafe condition and a second safety means connected to said second valve unit for automatically moving said valve member to a fully closed position on detection of an unsafe condition.

10. The assembly as claimed in claim 1, including feedback sensor means for detecting motion of said elevator car in response to variation in the size of the outlet orifice of either of said valve units, said feedback sensor means being connected to said control means, and said control means comprises means for controlling operation of said valve units in response to the input from said feedback sensor means so that the velocity of said elevator when moving upwardly or downwardly between floors follows a predetermined velocity profile.

11. The assembly as claimed in claim 10, wherein said feedback sensor comprises a position sensor.

12. A control valve assembly for controlling movement of a hydraulically operated elevator having an hydraulic cylinder and a ram in the cylinder for moving an elevator car up or down depending on the hydraulic pressure and flow into the cylinder, comprising:

a valve housing having an inlet for connection to a supply of pressurized fluid, a first outlet for connection to an elevator cylinder, and a passageway between the inlet and first outlet;

a check valve in said passageway, the check valve dividing said passageway into a first portion between said inlet and check valve, and a second portion between said check valve and outlet, the check valve being biassed into a closed position cutting off the first portion of the passageway from the second portion of the passageway, and movable into an open position when the elevator is to be moved upwards;

a first valve unit for controlling upward movement of the elevator, the first valve unit having a chamber connected to said first portion of said passageway, an adjustable first outlet orifice connecting said chamber to a reservoir, and first valve means for adjusting the size of said outlet orifice to control the flow of fluid from said inlet to said reservoir, said first valve means being movable between a normal, at least partially open position in which a substantial amount of fluid flows from said inlet to said reservoir and a closed position in which said first outlet orifice is closed;

a second valve unit for controlling downward movement of the elevator, the second valve unit having a chamber connected to said second portion of said passageway, an adjustable second outlet orifice connecting said chamber of said second valve unit to said reservoir, and second valve means for adjusting the size of said second outlet orifice to control the flow of fluid from said cylinder to said reservoir to lower said elevator, said second valve means being movable between a normal, closed position in which said second outlet orifice is closed to block flow of fluid from said elevator cylinder to said reservoir and an at least partially open position in which a selected amount of fluid flows from said cylinder into said reservoir to lower said elevator; and control means for controlling operation of said first and second valve units in response to input from an elevator controller to control flow of fluid into and out of said cylinder to raise and lower said elevator so that the velocity of said elevator follows a predetermined velocity curve as it moves from any start position to a selected stop position corresponding to a selected destination in an elevator shaft.

13. The assembly as claimed in claim 12, including an up safety valve for automatically moving said up valve means into an at least substantially open position on detection of an unsafe condition, and a down safety valve for automatically moving said down valve means into a fully closed position on detection of an unsafe condition.

14. The assembly as claimed in claim 12, wherein each valve unit comprises a cylinder, a piston slidable in said cylinder and dividing said cylinder into first and second chambers, said first and second outlet orifices being located in the first chambers of said up and down valve units, respectively, said pistons comprising said first and second valve means, up drive means for moving the piston of said up valve unit between said at least partially open and closed positions, and down drive means for moving the piston of said down valve unit between said closed and at least partially open positions.

15. The assembly as claimed in claim 14, wherein each piston has a connecting orifice for connecting the first and second chambers, said up and down means each comprising a control means for controlling the size of said respective connecting orifice, each connecting orifice comprising feedback means for controlling movement of the respective piston, to follow said control means.

16. The assembly as claimed in claim 15, wherein said second chamber of each valve unit has an outlet control orifice for controlling flow of fluid out of said second chamber, the pressure in said second chamber being dependent on the relative sizes of said respective connecting orifice and outlet control orifice, the first valve unit including a first safety valve for selectively connecting the second chamber of said first valve unit to a reservoir on detection of an unsafe condition when an elevator is moving upwardly, whereby pressure in said second chamber is reduced and said valve member moves to said at least partially open position, and said second valve unit includes a second safety valve for selectively blocking flow of fluid out of said second chamber on detection of an unsafe condition when the elevator is moving downwardly, whereby pressure in said second chamber increases and said valve member is biassed into said fully closed position.

17. The assembly as claimed in claim 14, wherein each piston is moved between its open and closed positions by variation in pressure in said second chamber, each piston having a balance condition in which a predetermined pressure differential exists between said first and second chambers, each piston having an orifice connecting said first and second chambers, and said drive means each comprising a control spool extending through the respective piston orifice, each control spool having a notch for controlling the size of the respective control orifice, and a stepper motor for moving the respective control spool, the pressure on opposite sides of the piston being dependent on the size of said control orifice, whereby movement of the respective control spools varies the pressure differential between the respective first and second chambers and thereby moves the respective piston in a direction towards the balance condition.

18. The assembly as claimed in claim 17, wherein each piston is of stepped diameter, having a first end exposed to the pressure in said first chamber which is of smaller diameter than the second end exposed to pressure in said second chamber, whereby a small change of pressure in said second chamber is sufficient to bias said piston in a selected direction.

19. The assembly as claimed in claim 12, wherein said control means includes feedback means for detecting actual elevator position and comparing the actual position to the controlled valve unit operation, and for varying the valve unit operation so that the elevator follows a predetermined velocity curve.

20. The assembly as claimed in claim 12, wherein said check valve is movable into said open position in response to a predetermined pressure difference between said first and second portions of said passageway.

21. The assembly as claimed in claim 20, including sensor means for detecting said pressure difference, said control means being responsive to a control signal for raising the elevator and the output of said sensor means to move said first valve means quickly towards a position at which the detected pressure difference is nearly equal to the pressure difference necessary to open the check valve and for moving said first valve means more slowly from that position to accelerate the elevator car upwardly according to said predetermined velocity profile.

22. A control valve assembly for controlling movement of an elevator car having a hydraulic cylinder and a ram in the cylinder for moving the elevator car up or down depending on hydraulic pressure and flow into the cylinder, the assembly comprising:

a first passageway for connecting a pump output to an elevator cylinder;

a check valve in said passageway for blocking flow of fluid from the elevator cylinder to the pump;

the check valve dividing said passageway into a first, pump-side chamber on one side of said check valve and a second, elevator cylinder-side chamber on the opposite side of said check valve;

a valve unit connected to said pump-side chamber for controlling flow rate of fluid into said elevator cylinder when said check valve is open;

said up valve unit comprising a cylinder, a piston movable in said cylinder to divide said cylinder into first and second chambers on opposite sides of said piston, the first chamber having an inlet connected to said pump-side chamber and an outlet orifice for connection to a reservoir, the piston being movable between an at least partially open position in which said outlet orifice is at a size such that all fluid is diverted from said pump through said outlet orifice, and a fully closed position in which said piston covers said outlet orifice to block flow of any fluid into said reservoir and direct all fluid from said pump into said elevator cylinder through said first passageway, movement of said piston being controlled by the difference in pressure between said first and second chambers;

said piston having a connecting orifice for connecting said first and second chambers to allow fluid to flow between said chambers, and a control spool extending through said connecting orifice and freely movable relative to said piston to control the size of said orifice and thereby the relative pressures in said first and second chambers;

drive means for moving said control spool in order to vary said connecting orifice and thus bias said piston to follow said control spool movement; and control means for controlling said drive means in response to input from an elevator controller to control movement of said control spool, and thus movement of said piston to vary the size of said outlet orifice so as to control flow of fluid into the elevator cylinder so that elevator movement follows a predetermined velocity profile as the elevator is moved upwardly between floors.

23. The assembly as claimed in claim 22, including a second valve unit separate from said first valve unit for controlling downward movement of said elevator, the second valve unit having an inlet for connection to the elevator cylinder, an outlet orifice for connection to the reservoir, and a valve member for controlling the size of the outlet orifice, the valve member being movable between a closed position in which said outlet orifice is blocked so that essentially no fluid flows out of said elevator cylinder and an at least partially open position in which said outlet orifice is sufficiently open so that fluid flows at a selected maximum rate out of said elevator cylinder.

24. The assembly as claimed in claim 23, wherein said second valve unit comprises a cylinder, a piston slidably mounted in said cylinder to divide it into first and second chambers, the first chamber of said second valve unit being connected to said elevator cylinder-side chamber, and said outlet orifice being located in the first chamber of said second valve unit, said piston of said down valve unit comprising said valve member, said piston being movable between a closed position completely covering said outlet orifice and an open position in which said outlet orifice is at least partially open, said piston being movable in response to variation in the pressure differential between said first and second chambers, and being in a balanced, stationary condition when said pressure differential is at a predetermined level, said second valve unit further comprising drive means for varying the pressure differential in order to drive the piston in a selected direction.

25. The assembly as claimed in claim 24, wherein said second valve unit piston has an orifice connecting said first and second chambers, and said drive means includes orifice control means for varying the size of said orifice, said orifice comprising means for controlling flow and thereby said pressure differential, said second chamber having an outlet orifice for controlling flow of fluid out of said second chamber.

26. The assembly as claimed in claim 25, wherein said orifice control means comprises a control spool extending through said orifice, said control spool having an elongate recess, the position of said recess relative to said orifice controlling the size of said orifice, and a stepper motor for moving said control spool relative to said orifice, whereby movement of said piston will follow that of said control spool.

27. The assembly as claimed in claim 22, wherein said piston has a first end facing said first chamber of a first diameter and a second end facing said second chamber of a second diameter larger than said first diameter, whereby a small change in pressure in said second chamber causes a greater change in force on the second end of said piston.

28. A method of controlling the movement of a hydraulically operated elevator having an elevator cylinder and a ram in said cylinder linked to the elevator to raise and lower the elevator in response to pressure changes in the elevator cylinder, comprising the steps of:

connecting the elevator cylinder to a pump for supplying hydraulic fluid to the cylinder in response to an elevator control signal to move the elevator upwards to a higher floor;

connecting the pump output to a reservoir via a variable output orifice of a first valve unit so that a controllable amount of fluid flows from the pump output to the reservoir in order to vary the input to the elevator cylinder;

moving an up valve member of the first valve unit to vary the size of the output orifice to the reservoir in response to a predetermined elevator velocity profile and feedback from an elevator motion sensor in order to drive the elevator between a parked position and a selected destination according to the velocity profile, including adjusting the size of the output orifice in response to any variation between the desired velocity profile and the detected elevator motion; and moving the valve member to substantially open the output sufficiently to allow all fluid from the pump to flow to the reservoir when the elevator arrives at the selected floor.

29. The method as claimed in claim 28, including the steps of connecting the elevator cylinder to a second valve unit separate from the first valve unit, moving a second valve member of the second valve unit in response to an elevator control signal to move the elevator downwards to a lower floor;

adjusting the position of the second valve member according to the predetermined elevator velocity profile and feedback from the elevator motion sensor to vary the size of a second outlet orifice connecting the elevator cylinder to a reservoir so as to control the flow of fluid out of the elevator cylinder and thus the rate of descent of the elevator from a parked position to a selected lower destination; and moving the valve member of the down valve unit to a fully closed position blocking further flow of fluid from the elevator cylinder when the elevator arrives at a selected lower floor.

* * * * *